United States Patent [19]

Bogovich

[11] Patent Number: 4,480,458

[45] Date of Patent: Nov. 6, 1984

[54] CONTROLLED COUNTER-DRAFTING TO REDUCE CROP LOSS DURING INGOT ROLLING

[75] Inventor: Robert E. Bogovich, Munhall, Pa.

[73] Assignee: United States Steel Corporation, Pittsburgh, Pa.

[21] Appl. No.: 514,392

[22] Filed: Jul. 18, 1983

[51] Int. Cl.[3] ..... B21B 41/06; B21B 1/00

[52] U.S. Cl. ..... 72/229; 72/366

[58] Field of Search ..... 72/226, 229, 365, 366, 72/206

[56] References Cited

U.S. PATENT DOCUMENTS 4,344,309 8/1982 Matsuzaki ..... 72/226

FOREIGN PATENT DOCUMENTS 52-36503 9/1977 Japan ..... 72/366

56-91908 7/1981 Japan ..... 72/206

58-70902 4/1983 Japan ..... 72/366

*Primary Examiner*—E. Michael Combs

*Assistant Examiner*—Charles Rosenberg

*Attorney, Agent, or Firm*—Arthur J. Greif

[57] ABSTRACT

A method for decreasing the extent of crop loss during rolling of ingots to semifinished products, such as slabs and blooms, in which a lighter than usual draft is taken during the odd pass, i.e. as the ingot bottom enters the rolls. During the subsequent even pass, as the ingot top enters the rolls, the draft taken is of the usual order of magnitude. These steps of alternate light and heavy passes are conducted until the ingot thickness is about twice the length of the maximum practically achievable contact arc—then the normal drafting sequence is utilized. A yield gain of about 1% or greater may thus be achieved by using such controlled counter-drafting.

9 Claims, No Drawings

CONTROLLED COUNTER-DRAFTING TO REDUCE CROP LOSS DURING INGOT ROLLING

This invention relates to a process for decreasing the extent of mechanical overlap formed during slabbing of ingots, and is more particularly related to a method for reducing the extent of crop loss caused during such rolling by the formation of such fishtails at both ends of a semifinished product.

In the manufacture of steel products from ingots, the hot ingot is first rolled into a semifinished product, such as a slab or a bloom. As a result of such rolling, the ends of the semifinished product become distorted by the rolling action and form what the art refers to as "fishtails". To provide a sound semifinished product, these fishtails must be cropped and discarded—such discard or crop loss generally amounting to about 8 to 10 percent of the initial weight of the ingot. The distorted, concave shape known as "fishtails" is the natural result of the rolling action. As the ingot is rolled, it is progressively squeezed to the desired cross-sectional dimensions of the semifinished form. Some of the steel is pushed ahead of the rolls and results in an over-rolling or mushrooming effect on the ends. Such over-rolling can be repeated on all four sides as the ingot is rotated 90° to reduce it to the final dimensions so that the ends can be mushroomed in both the vertical and horizontal directions of the end portions of the slab or bloom. A number of methods have been employed, all designed to provide a taper on the ends of the ingot, to counter the mushroom effect of rolling. One such method relies on the use of contoured stools and mold tops with sloping shoulders, to provide an ingot with the desired tapered ends. Another such method, shown in Japanese Patent Application No. 55-64902, employs the use of a press or forge to form the ingot into the shape of a truncated cone or pyramid. Another such method, shown in U.S. Pat. No. 4,344,309, the disclosure of which is incorporated herein by reference, involves the same mechanics. In this case (known to the art as the "bite and back" rolling method), the taper on the ends of the ingot is accomplished at the time of rolling. When compared with the rolling of a non-tapered ingot, use of the above tapering procedures can provide an increase in slab yield of from 2 to 4 percent. Although such improvement in the yield is highly significant, all the above tapering procedures require a costly or time-consuming extra step to achieve the requisite taper. Thus, (i) the provision of a taper at the ingot casting stage requires new mold designs, (ii) the method shown in the Japanese Patent requires an extra step of transporting the ingot to a distinct forging stage, and (iii) the "bite and back" method requires very careful control—necessitating the full view of the Roller located in the operator's pulpit, which is generally downstream of the mill rolls. It was found, that enhanced slab yields of the order of 1% or greater could be achieved much more easily, by optimizing the rolling path schedule, such that a lighter than usual draft (e.g. $\frac{3}{8}$") is taken as the ingot bottom enters the rolls in the odd passes; while during the subsequent even passes, a draft of a usual order of magnitude (e.g. $1\frac{1}{2}$") is taken. These steps of alternating light and heavy passes are conducted until the ingot thickness is about twice the length of the arc of contact (e.g. 12"), then the normal drafting sequence may be utilized.

During rolling, the stresses penetrate the ingot to a depth approximately equal to the length of the roll surface arc of contact "L", in which $L=\sqrt{r\times d}$, wherein "r" is the roll radius and "d" is the draft taken. When the stresses penetrate to about the center of the ingot, the cross-sectional stress distribution promotes substantially uniform deformation. Thus, when the ingot thickness is equal to or less than about twice "L", approximately uniform cross-sectional deformation can be achieved and fishtailing substantially eliminated. However, while the use of extremely heavy passes to enable the stresses to penetrate past the half thickness of the ingot would be desirable for the elimination of fishtailing, the taking of such extremely heavy passes is practically limited by the stiffness of the rolls and the power required to drive them. Given such practical limitations, the magnitude of the drafts actually taken during the initial stages of ingot reduction results in stresses being localized near the ingot surface, mostly away from the center of the ingot. The undesirable surface elongation which causes fishtails results from such surface stress localization. This surface elongation is comprised of basically two components: (i) surface elongation due to the roll bite, which deforms the surface in the direction of the rolls and (ii) a second elongation occurring in the direction opposite the path of the ingot toward the ingot back end, due to the resultant horizontal force component of the tangential forces exerted along the contact arc. It was determined by visual observation that the degree of slab end non-rectangularity and elongation resulting from the initial roll bite was substantially greater than that of the second elongation. It was therefore theorized that if a lighter draft were taken at the lead end (odd pass) of the ingot, which is normally the ingot bottom, and a usual draft were taken on the even pass, that the extent of such surface elongation and non-rectangularity could be minimized. Such alternating light and heavy drafts would be taken until the ingot was approximately twice the length of the contact arc and thereafter the ingot could be rolled to the desired slab gauge using the conventional heavy drafting sequence on both passes so as to minimize the increase in rolling rate resulting from use of lighter drafts in the odd pass. To evaluate this hypotheses, two-stock 29"×66" ingots were employed. Prior to heating, the bottoms of both ingots were flame cut to similar configurations. The ingots were heated in the same pit and rolled to $5\frac{1}{2}$" gauge×64" width utilizing the following drafting practices.

(1) Both ingots were first edged and then rolled flat to remove taper and scale in accord with conventional practice.

(2) (Odd Pass) For the conventional ingot, a usual draft of $1\frac{1}{2}$" was taken; while for the experimental ingot, a draft of $\frac{3}{8}$" was employed.

(3) (Even Pass) A draft of $1\frac{1}{2}$" was taken for both ingots during this pass.

(4) Steps 2 and 3 were conducted until the experimental ingot was approximately 12" thick. At that point, both ingots were rolled to finished gauge by conventional rolling procedure utilizing drafts in both odd and even passes of $1\frac{1}{2}$".

The ingot bottom ends were sonic tested, flame-cut and weighed. The crop loss of the conventionally rolled ingot was 1650 lbs., while that of the controlled counter-drafted ingot was 1230 lbs., a yield gain of 420 lbs. This difference amounted to a yield gain of approximately 1%, with a sacrifice in increased rolling rate of only about 1 minute.

It is therefore seen, merely in judicious control of the ratios of the draft taken in the odd and even passes, that significant yield gains can be achieved in a rather simple fashion, without undue sacrifice in production. The ratio of the lighter draft to heavier draft will generally be within the range of 0.04 to 0.06. Use of ratios within the lower end of the range will provide greater yield gains, but with somewhat greater sacrifice in production. Therefore, ratios of from 0.15 to 0.35 are preferred, since they provide a desirable balance of enhanced yield, without unduly increasing the rolling rate.

I claim:

1. In the production of semifinished products from an ingot, which comprises; in an odd pass, feeding a leading end of the ingot between at least one pair of counter-rotating rolls of a roll system to squeeze the ingot therebetween to a smaller thickness, after the ingot has pased completely through the rolls, in the next (even) pass, reversing the rotation of the rolls and feeding the previously trailing end of the ingot between the reverse rotating rolls to further reduce the ingot thickness therebetween, without reheating the ingot, repeating said odd and even passes to produce a semifinished product, said ingot having an original thickness significantly thicker than twice the length of the maximum practically achievable arc of contact, $L_{max.}$, of said roll system, the improvement for decreasing the amount of crop-loss caused by fishtails which result from said rolling, which comprises; during a first controlled stage of rolling, controlling the ratio of the drafts taken in said odd and even passes such that the draft taken in substantially all of said odd passes is lighter than the draft taken in said even passes, wherein said lighter drafts are 0.04 to 0.6 the draft of said heavier drafts.

2. The method of claim 1, wherein the ingot is edged and rolled to remove its taper and scale prior to said first controlled stage of rolling.

3. The method of claim 2, wherein said ingot leading end is the ingot bottom.

4. The method of claim 3, wherein during the first controlled stage, the draft taken in all of said odd passes is lighter than the draft taken in all of said even passes.

5. The method of claim 4, wherein the draft schedule of said first controlled stage is terminated when the ingot thickness is reduced to a point at which it is about twice as thick as $L_{max}$, and in a subsequent stage, employing a draft schedule in which the drafts taken in said odd and even passes are approximately equal to $L_{max}^2/r$, where "r" is the roll radius.

6. The method of claim 5, wherein said lighter drafts are 0.15 to 0.35 the draft of said heavier drafts.

7. The method of claim 1, wherein said ingot leading end is the ingot bottom.

8. The method of claim 7, wherein the draft schedule of said first controlled stage is terminated when the ingot thickness is reduced to a point at which it is about twice as thick as $L_{max}$, and in a subsequent stage, employing a draft schedule in which the drafts taken in said odd and even passes are approximately equal to $L_{max}^2/r$, where "r" is the roll radius.

9. The method of claim 8, wherein said lighter drafts are 0.15 to 0.35 the draft of said heavier drafts.

* * * * *